US006886693B1

(12) United States Patent
Davenport et al.

(10) Patent No.: US 6,886,693 B1
(45) Date of Patent: May 3, 2005

(54) CHILD CARE APPARATUS

(76) Inventors: Robert Davenport, 4233 E. Molly La., Cave Creek, AZ (US) 85331; Jeffrey D. Williams, 516 E. Cheery Lynn, Phoenix, AZ (US) 85012; Torrey L. Porter, 14816 W. Parkwood Dr., Surprise, AZ (US) 85374

( * ) Notice: Subject to any disclaimer, the term of this patent is extended or adjusted under 35 U.S.C. 154(b) by 26 days.

(21) Appl. No.: 09/887,222

(22) Filed: Jun. 22, 2001

Related U.S. Application Data

(63) Continuation of application No. 09/315,925, filed on May 20, 1999, now abandoned.

(51) Int. Cl.[7] ..... B65D 73/00; B65D 1/24; B65D 25/10

(52) U.S. Cl. ..... 206/494; 220/542; 220/549; 220/550; 220/756

(58) Field of Search ..... 220/546, 540, 220/541, 543, 544, 542, 533, 524, 526, 525, 523, 756; 206/494

(56) References Cited

U.S. PATENT DOCUMENTS

| | | | | | |
|---|---|---|---|---|---|
| 247,316 | A | * | 9/1881 | Crane | 220/909 |
| 960,833 | A | * | 6/1910 | Crum | 220/543 |
| 1,116,184 | A | * | 11/1914 | Weiss | 220/546 |
| 1,275,695 | A | * | 8/1918 | Iverson | 220/756 |
| 1,542,927 | A | * | 6/1925 | Whitaker | 206/373 |
| 2,482,099 | A | * | 9/1949 | Cleven et al. | 220/545 |
| 3,612,337 | A | * | 10/1971 | Harger | 220/546 |
| 3,710,974 | A | * | 1/1973 | Hage | 220/546 |
| 3,885,668 | A | * | 5/1975 | McClain | 220/541 |
| 3,887,103 | A | * | 6/1975 | Spooner | 206/373 |
| 4,940,159 | A | * | 7/1990 | Callas et al. | 220/909 |
| 5,050,768 | A | * | 9/1991 | Alden | 220/909 |
| 5,082,139 | A | * | 1/1992 | Quam | 220/544 |
| 5,103,998 | A | * | 4/1992 | Caro et al. | 220/909 |
| 5,184,744 | A | * | 2/1993 | Paulison | 220/909 |
| 6,024,241 | A | * | 2/2000 | Keillor | 220/540 |

* cited by examiner

*Primary Examiner*—Joseph Man-Fu Moy
(74) *Attorney, Agent, or Firm*—Parsons&Goltry; Robert A. Parsons; Michael W. Goltry

(57) ABSTRACT

A framework supporting a substantially moisture-sealed enclosure and a wall that cooperates with the framework to define an open compartment, wherein the wall is movable along a reciprocal path for adjusting the size of the open compartment.

18 Claims, 2 Drawing Sheets

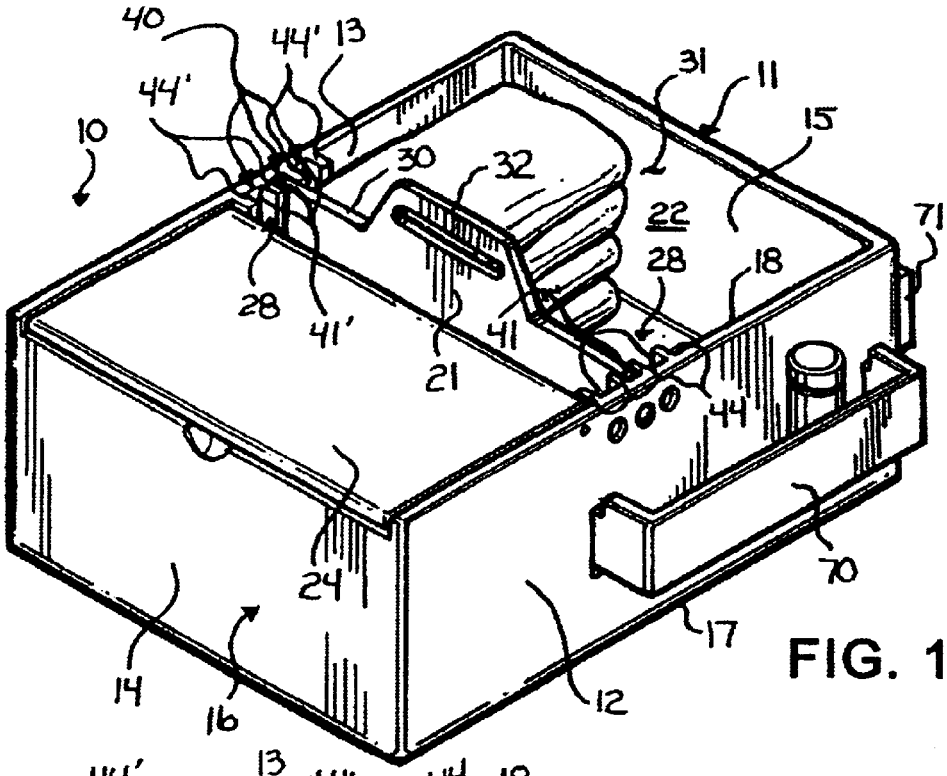
FIG. 1
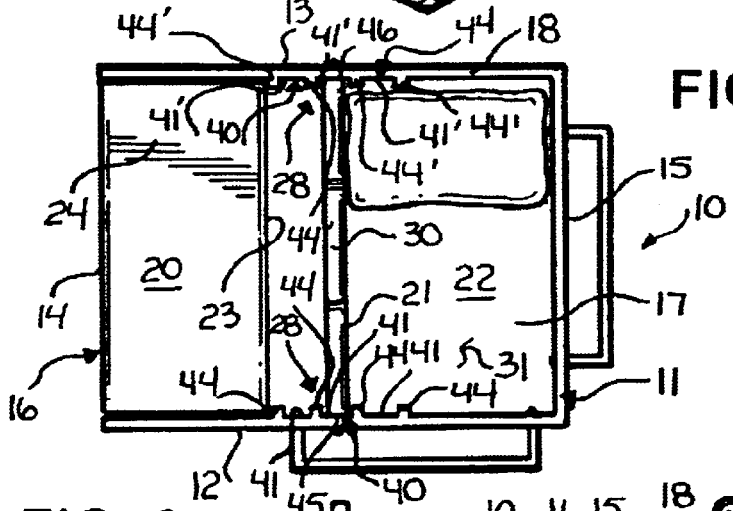
FIG. 2
FIG. 3
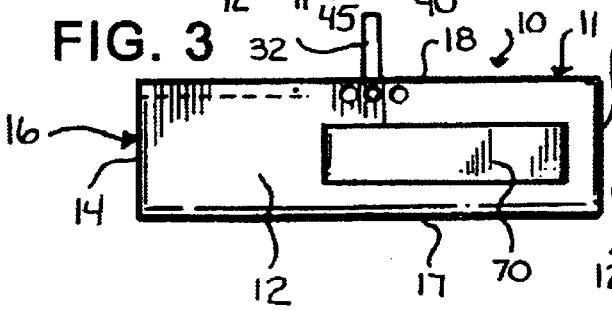
FIG. 4
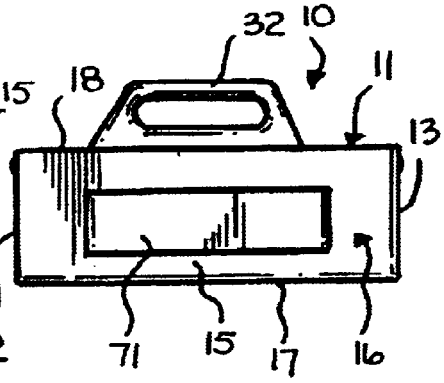

CHILD CARE APPARATUS

This is a continuation of Ser. No. 09/315,925 filed May 20, 1999, now abandoned.

FIELD OF THE INVENTION

This invention relates to convenience apparatus and, more particularly, to apparatus for containing diapers and for containing cloth-like articles in a moistened condition.

BACKGROUND OF THE INVENTION

A diaper is garment worn by infants and toddlers for containing bodily waste. Diapers are constructed of disposable materials or washable cloth or cloth-like materials. When changing soiled diapers, parents customarily use cloth or cloth-like wipes or towelettes moistened with a mild cleaning solution to clean away any remaining bodily waste from the child. It is obviously important for parents to keep an adequate supply of wipes and diapers at least up until the child is potty trained, which may not come until the child is two or three years old. As a result, skilled artisans have devised tote bags and other similar portable devices for allowing the easy and efficient storage and transport of not only diapers and sanitary wipes, but also other child care products such as combs and brushes, cloths, lotions, juice bottles and snack food. Although exemplary, the current structural features of tote bags and other similar portable devices for accommodating child care items for storage and transport prove difficult and cumbersome to use, expensive and inefficient for allowing parents quick and easy access to stored items as needs arise. Based on these and other deficiencies in the art, the continued need for new and useful improvements is evident.

Accordingly, it would be highly desirable to provide improved new and improved apparatus for accommodating child care products for storage and transport.

It is a purpose of the invention to provide new and improved apparatus that is easy to construct.

It is another purpose of the invention to provide new and improved apparatus that is easy to use.

It is still another purpose of the invention to provide new and improved apparatus that is inexpensive.

It is a further purpose of the invention to provide new and improved apparatus that proves particularly useful for accommodating diapers and cloth or cloth-like wipes moistened with a cleansing solution.

It is still a further purpose of the invention to provide new and improved apparatus for storing cloth or cloth-like wipes in a moistened condition.

It is yet still a further purpose of the invention to provide new and improved apparatus that is adjustable for accommodating diapers of varying size.

It is another provision of the invention to alleviate the inconvenience and frustration commonly experienced by parents when trying to access child care products from a storage container, tote bag or other known portable storage device.

It is still another purpose of the invention to provide new and improved apparatus that is compact and easy to transport and load with a variety of child care products.

SUMMARY OF THE INVENTION

The above problems and others are at least partially solved and the above purposes and others realized in new and improved apparatus comprising a framework supporting an enclosure and a wall that cooperates with the framework to define an open compartment. The enclosure is preferably substantially moisture-sealed for containing cloth or cloth-like wipes or towelettes in a moistened condition, and the wall is movable along a reciprocal path for adjusting the size of the open compartment to conform substantially with the size of, for instance, one or more diapers. A lid is mounted to serve as a substantially moisture-sealed closure for the enclosure.

The framework supports structure for receiving the wall at selected positions along the reciprocal path. In a particular embodiment, the structure comprises pairs of opposing slots, each pair for accommodating edges of the wall. Engagement structure secures the wall to the framework at selected positions along the reciprocal path. The engagement structure comprises engagement apparatus carried by one of the wall and the framework and detachably engagable complemental engagement apparatus carried by the other one of the wall and the framework. The engagement apparatus may comprise male engagement elements, and the complemental engagement apparatus may comprise female engagement elements each for accommodating one of the male engagement elements. The wall supports a handle that may be grasped for easy transport.

BRIEF DESCRIPTION OF THE DRAWINGS

The foregoing and further and more specific objects and advantages of the invention will become readily apparent to those skilled in the art from the following detailed description taken in conjunction with the drawings in which:

FIG. 1 is an isometric view of an apparatus comprising a framework supporting an auxiliary container, an enclosure and a wall or partition that cooperates with the framework to define an open compartment, wherein the wall is movable along a reciprocal path for adjusting the size of the open compartment;

FIG. 2 is a top plan view of the apparatus of FIG. 1;

FIG. 3 is a side elevational view of the apparatus of FIG. 1;

FIG. 4 is an end elevational view of the apparatus of FIG. 1;

DETAILED DESCRIPTION OF A PREFERRED EMBODIMENT

Figures 5, 6, 7:
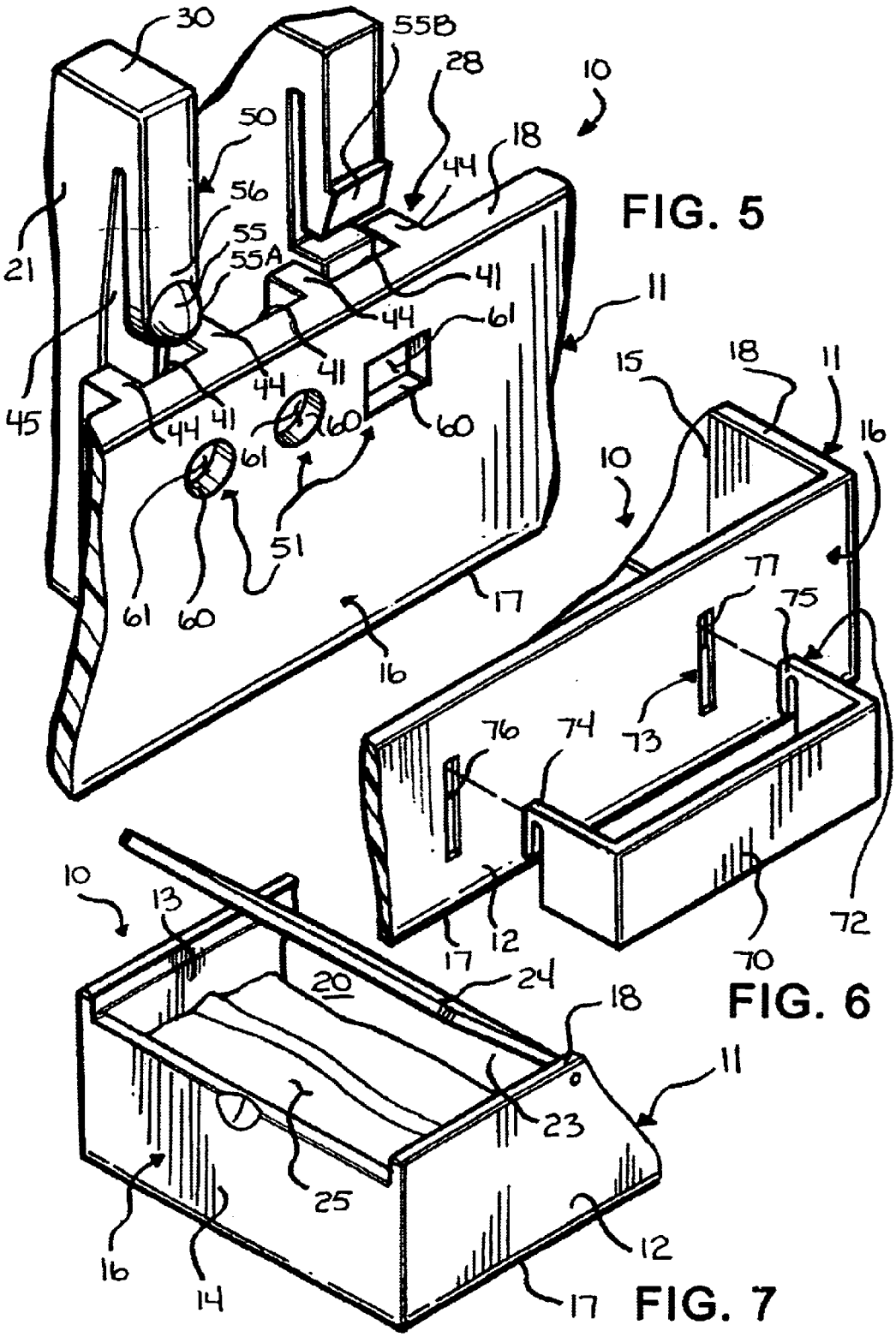
FIG. 5 is a an isometric view of embodiments of an engagement assembly for engaging the wall with the framework.
FIG. 6 is an isometric view of the auxiliary container of FIG. 1 shown as it would appear detached from the framework.
FIG. 7 is an isometric view of the enclosure of FIG. 1.

The present invention provides, among other things, new and improved apparatus for accommodating diapers, moistened cloth or cloth-like wipes or towelettes and other baby care products. Ensuing embodiments of the invention are easy to construct, easy to use and provide parents with a convenient and useful device not only for storing and transporting baby care products, but also for allowing parents easy access to the baby care products when needs arise.

Turning now to the drawings, in which like reference characters indicate corresponding elements throughout the several views, attention is first directed to FIG. 1 which illustrates an isometric view of apparatus 10 for containing diapers, moistened cloth or cloth-like wipes or towelettes and other baby care products for storage and transport. Referring also to FIG. 2, apparatus 10 is comprised of a framework 11 including side panels 12 and 13 and end panels 14 and 15 that cooperate to form a continuous sidewall 16. Continuous sidewall 16 includes a closed lower end 17 and an upper end 18. Framework 11, which is preferably constructed of plastic or the like, supports a compartment 20 directed toward end panel 14 and a partition or wall 21 intermediate end panels 14 and 15 that cooperates with framework 11 to define a compartment 22 directed toward end panel 15.

Turning to FIG. 7, compartment 20 comprises an enclosure defined by a portion of closed end 17 and a continuous sidewall defined by a portion of side panels 12 and 13, end panel 14 and end panel 23 which is spaced from and opposed to end panel 14. End panel 23 extends upwardly from closed end 17 of framework 11 and terminates adjacent upper end 18. Edges of side panels 12 and 13 and end panels 14 and 23 directed to upper end 18 of framework 11 cooperate to bound an opening 25 that leads to compartment 20. A lid 24 mounted for hinged or pivotal movement to framework 11 between open (FIG. 7) and closed (FIGS. 1 and 2) positions serves as a closure for opening 25. In its closed position, lid mates against the edges of side panels 12 and 13 and end panels 14 and 23 that bound opening 25 in substantial sealing engagement.

Compartment 20 is designed for accommodating cloth or cloth-like wipes or towelettes of the type used to clean away bodily waste from infants and toddlers during diaper changing. Wipes of this type are commonly found moistened with a cleansing liquid, and are found under many exemplary trademarks including, for instance, PAMPERS™ and HUGGIES ™. Although compartment 20 could certainly accommodate a container of wipes, moistened wipes, such as those provided as refills, may be placed directly into compartment 20 for storage and transport. In this regard, with lid 24 in its closed position, the compartment 20 is substantially moisture-sealed which maintains the wipes in their moistened condition and prevents them from drying out. Therefore, parents can store wipes in container 20 in a moistened condition without having to worry about housing the wipes in a separate moisture-sealed container. Although not shown, a snap or other similar engagement assembly could be provided for engaging lid 24 with framework 11 in its closed position.

Turning back to FIG. 2, compartment 22 is defined by a portion of closed end 17 and a continuous sidewall defined by a portion of side panels 12 and 13, end panel 15 and wall 21. Structure 28 carried by framework 11 accommodates wall 21. When mounted with structure 28, wall 21 opposes end panel 15 in spaced relation and extends toward upper end 18 of framework 11 from closed end 17 terminating with an edge 30. The edges of side panels 12 and 13 and end panel 13 directed to upper end 18 of framework 11 cooperate with edge 30 to bound an opening 31 that leads to compartment 22. A handle 32 extends upwardly from edge 30 that may be grasp for carrying apparatus 10.

Compartment 22 is open and designed for receiving and accommodating disposable or washable diapers of the type for containing infant or toddler bodily waste. Diapers fitting this descriptive classification are found in a variety of sizes for, of course, accommodating infants and toddlers of varying size. For instance, disposable diapers, such as those found under PAMPERS™, HUGGIES™ and other exemplary trademarks, are found in sizes ranging from "1" for infants to "5" for toddlers, and even larger sizes. To permit diapers of varying size to be stored snugly and efficiently in compartment 22, the size of compartment 22 is adjustable by adjusting the position of wall 21 either toward end panel 15 or toward end panel 23. In this regard, wall 21 is adjustable with framework 11 along a reciprocal path between a first position toward end wall 23 and a second position toward end wall 15. In the first position, compartment 22 defines a size or area for accommodating diapers of a certain size and in the second position, compartment 22 defines a lesser size or area for accommodating diapers of a lesser size.

In the present embodiment, the structure 28 for accommodating adjustment of wall 21 along a reciprocal path is comprised of pairs 40 of opposing channels or slots 41 and 41' supported by side panels 12 and 13, respectively, between end panel 14 and end panel 15. Channels 41 are formed and defined by a plurality of ribs 44 carried by side panel 12 at spaced intervals. Ribs 44 extend inwardly toward side panel 13. Channels 41' are formed and defined by a plurality of ribs 44' carried by side panel 13 at spaced intervals. Ribs 44' extend inwardly toward side panel 12.

Each channel 41 is operative for accommodating a side edge 45 of wall 21, and each opposing channel 41' is operative for accommodating the other side edge 46 of wall 21. Regarding FIG. 2, each pair 40 accommodates wall 21 at a different position. The pair 40 nearest compartment 20 defines the first position of wall 21, and the pair 40 nearest end panel 15 defines the second position of wall 21. Although three pairs of channels are shown, less or more may be used as needed. Furthermore, FIG. 2 shows wall 21 as it would appear mounted with structure 28 between its first and second positions forming a small open compartment 47 between wall 21 and end panel 23. This open compartment 47 is useful for accommodating juice bottles, snacks, toys, etc., and may also be formed in a somewhat larger size with wall 21 in its second position.

To secure wall 21 with framework 11 at selected positions along the reciprocal path, shown is engagement structure 50. The ability to secure wall 21 with framework 11 is desirable because it allows apparatus 10 to be carried by handle 32. Engagement structure 50 comprises engagement apparatus 51 carried by wall 21 and detachably engagable complemental engagement apparatus 52 carried by framework 11 and, more particularly, by side panels 12 and 13 (not shown in FIG. 5). The positioning of engagement apparatus 51 and complemental engagement apparatus 52 may be reversed if desired. Engagement apparatus 51 comprises a male engagement element 55 supported by wall 21 adjacent side edge 45. Male engagement element 55 is preferably provided in the form of a rounded protuberance 55A, but it could be provided as an angular or substantially square protuberance 55B in another embodiment or other desired protuberant shape. In this embodiment, male engagement element 55 is carried adjacent a free end 56 of an elongate body 57 depending and extending downwardly from edge 30 adjacent edge 45. Although not shown in the drawings, engagement apparatus 51 also includes another male engagement element supported by wall 21 adjacent side edge 46. Like male engagement element 55, the other male engagement element is preferably carried adjacent a free end of another elongate body depending and extending downwardly from edge 30 adjacent edge 46. The elongate bodies that support the male engagement elements are flexible. This flexibility permits them to be flexed inwardly so that each male engagement element can pass into each one of the channels 41 and, 41', respectively, of each pair 40. From their inwardly flexed condition, the elongate bodies exhibit an outward bias which forces the male engagements elements to engage against complemental engagement apparatus 51.

Complemental engagement apparatus 51 comprises a plurality of female engagement elements 60 each for accommodating one of the male engagement elements. Female engagement elements 60 are positioned at spaced intervals each adjacent one of channels 41 and 41'. Each female engagement element 60 is comprised of an aperture 61, but each could comprise a recess if desired. Each aperture 61 may be provided as round, square or other shape suitable for mating with a corresponding male engagement element.

The invention has been described above with reference to one or more preferred embodiments. However, those skilled in the art will recognize that changes and modifications may be made in the described embodiments without departing from the nature and scope of the invention. For instance FIGS. 1–4 show external auxiliary containers 70 and 71 shown carried by framework 11 for accommodating lotion bottles, juice bottles, etc. Auxiliary container 70 is shown carried by side panel 12, and auxiliary container 71 is shown carried by end panel 15. Auxiliary containers 70 and 71 could, of course, be mounted at other locations along framework 11 if desired. Each auxiliary container 70 and 71 may be fixed to framework or detachably engaged to framework. As a matter of example in FIG. 6, auxiliary container 70 is shown having an engagement assembly 72 detachably engagable with a complemental engagement assembly 73 carried by side panel 12 of framework 11. In this embodiment, engagement assembly 72 comprises a pair of hook elements 74 and 75 and complemental engagement assembly comprises a corresponding pair of slots 76 and 77 each for accommodating one of the hook elements 74 and 75 in detachable engagement. Other engagement structure may be used sufficient for providing detachably engagement.

Various changes and modifications to one or more of the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. Apparatus comprising a framework supporting a first compartment having a back wall, a movable wall that cooperates with the framework to define a second compartment and a third compartment positioned between the back wall of the first compartment and the second compartment, wherein the movable wall is movable along a reciprocal path for adjusting the size of the second compartment and the third compartment and a handle carried by the wall.

2. Apparatus of claim 1, wherein the first compartment is substantially moisture-sealed for storing one or more articles in a moistened condition.

3. Apparatus of claim 1, wherein the framework supports structure for receiving the movable wall at selected positions along the reciprocal path.

4. Apparatus of claim 1, wherein the structure comprises pairs of opposing slots, each pair for accommodating edges of the movable wall.

5. Apparatus of claim 1, further including engagement structure for securing the movable wall at selected positions along the reciprocal path.

6. Apparatus of claim 5, wherein the engagement structure comprises:

engagement apparatus carried by one of the movable wall and the framework; and detachably engagable complemental engagement apparatus carried by the other one of the movable wall and the framework.

7. Apparatus of claim 6, wherein the engagement apparatus comprises male engagement elements.

8. Apparatus of claim 7, wherein the complemental engagement apparatus comprises female engagement elements each for accommodating one of the male engagement elements.

9. Apparatus of claim 2, further including a lid mounted to serve as a substantially moisture-sealed closure for the first compartment.

10. An assembly, comprising a framework supporting a substantially moisture-sealed enclosure housing one or more cloth-like articles in a moistened condition and a movable wall that cooperates with the framework to define an open compartment housing one or more diapers, wherein the movable wall is movable along a reciprocal path for adjusting the size of the open compartment to accommodate the size of the one or more diapers.

11. The assembly of claim 10, further including a lid mounted to serve as a substantially moisture-sealed closure for the substantially moisture-sealed enclosure.

12. The assembly of claim 10, wherein the framework supports structure for receiving the movable wall at selected positions along the reciprocal path.

13. The assembly of claim 12, wherein the structure comprises pairs of opposing slots, each pair for accommodating edges of the movable wall.

14. The assembly of claim 10, further including engagement structure for securing the movable wall at selected positions along the reciprocal path.

15. The assembly of claim 14, wherein the engagement structure comprises:

engagement apparatus carried by one of the movable wall and the framework; and detachably engagable complemental engagement apparatus carried by the other one of the movable wall and the framework.

16. The assembly of claim 15, wherein the engagement apparatus comprises male engagement elements.

17. The assembly of claim 16, wherein the complemental engagement apparatus comprises female engagement elements each for accommodating one of the male engagement elements.

18. The assembly of claim 10, wherein the movable wall supports a handle.

* * * * *